US008393130B2

(12) United States Patent
Stubblefield

(10) Patent No.: US 8,393,130 B2
(45) Date of Patent: Mar. 12, 2013

(54) DOOR MODULE FOR A REFRIGERATED CASE

(75) Inventor: Steven O. Stubblefield, Mechanicsville, VA (US)

(73) Assignee: Hill Phoenix, Inc., Conyers, GA (US)

( * ) Notice: Subject to any disclaimer, the term of this patent is extended or adjusted under 35 U.S.C. 154(b) by 34 days.

(21) Appl. No.: 13/086,320

(22) Filed: Apr. 13, 2011

(65) Prior Publication Data

US 2011/0304252 A1 Dec. 15, 2011

Related U.S. Application Data

(60) Provisional application No. 61/353,071, filed on Jun. 9, 2010.

(51) Int. Cl.
*E04C 2/54* (2006.01)

(52) U.S. Cl. ..... 52/786.1; 52/204.593; 52/786.13

(58) Field of Classification Search ..... 52/204.593, 52/204.6, 173.1, 786.1, 786.11, 786.13, 783.1, 52/456, 171.1; 62/246; 312/116; 428/34; 49/501, 504, 386, 70, 425; 160/371; 427/164
See application file for complete search history.

(56) References Cited

U.S. PATENT DOCUMENTS 3,177,989 A * 4/1965 Di Chiaro ..... 49/425
3,673,735 A * 7/1972 Winsler et al. ..... 49/70
4,145,844 A * 3/1979 Kaspar ..... 49/386
4,753,043 A * 6/1988 Bockwinkel ..... 49/501
5,113,628 A * 5/1992 Richardson et al. ..... 52/171.3
5,636,484 A * 6/1997 DeBlock ..... 52/204.5
6,029,411 A * 2/2000 Richardson ..... 52/204.51
6,148,563 A 11/2000 Roche et al.
6,393,768 B1 5/2002 Roche et al.
6,820,952 B2 11/2004 Austin et al.
7,213,375 B2 * 5/2007 Morgan et al. ..... 52/204.6
7,246,470 B2 * 7/2007 Beyrle ..... 52/171.1
7,318,321 B2 1/2008 Grassmuck et al.
7,434,950 B2 10/2008 Whitney
7,681,369 B2 * 3/2010 Soltesiz et al. ..... 52/456
7,856,770 B2 12/2010 Grassmuck et al.
7,870,704 B2 1/2011 Riblier et al.
7,891,154 B2 2/2011 Cording
2006/0059861 A1 3/2006 Grassmuck et al.
2006/0103269 A1 5/2006 Artwohl et al.
2007/0022667 A1 * 2/2007 Olofsson ..... 49/504
2008/0211359 A1 9/2008 Borgstrom et al.
(Continued)

OTHER PUBLICATIONS

U.S. Appl. No. 13/101,047, filed May 4, 2011, Howington et al.

(Continued)

*Primary Examiner* — Brian Glessner
*Assistant Examiner* — Beth Stephan
(74) *Attorney, Agent, or Firm* — Foley & Lardner LLP

(57) ABSTRACT

A door module for a refrigerated case includes a central panel with a peripheral flange. A first panel is disposed on one side of the central panel and is supported by the flange. A second panel is disposed on another side of the central panel and is supported by the flange. A first seal is disposed between the first side of the flange and the first panel, and a second seal is disposed between the second side of the flange and the second panel. A channel with a desiccant material is disposed within the flange. A first opening extends from the channel to a first space between the first panel and the central panel, and a second opening extends from the channel to a second space between the second panel and the central panel. A frame is coupled to the flange and overlaps the first and second panels.

16 Claims, 3 Drawing Sheets

U.S. PATENT DOCUMENTS

| | | | | |
|---|---|---|---|---|
| 2009/0072679 | A1 | 3/2009 | Avila et al. | |
| 2009/0151265 | A1 * | 6/2009 | Gillen | 49/413 |
| 2009/0288343 | A1 | 11/2009 | Romolo | |
| 2010/0062152 | A1 | 3/2010 | Roche et al. | |
| 2010/0068398 | A1 | 3/2010 | Roche et al. | |
| 2010/0119705 | A1 * | 5/2010 | Roche et al. | 427/164 |
| 2010/0139036 | A1 | 6/2010 | Romolo | |
| 2010/0192468 | A1 | 8/2010 | Chubb et al. | |
| 2010/0205991 | A1 | 8/2010 | Ernst et al. | |
| 2011/0043089 | A1 | 2/2011 | Chubb et al. | |
| 2011/0100044 | A1 | 5/2011 | Reichert et al. | |
| 2011/0126561 | A1 | 6/2011 | Sunderland et al. | |

OTHER PUBLICATIONS

U.S. Appl. No. 13/103,680, filed May 9, 2011, Stubblefield.

U.S. Appl. No. 13/105,703, filed May 11, 2011, Howington et al.

* cited by examiner

DOOR MODULE FOR A REFRIGERATED CASE

CROSS REFERENCE TO RELATED APPLICATIONS

The present Application claims the benefit of priority under 35 U.S.C. §119(e)(1) of U.S. Provisional Patent Application No. 61/353,071, titled "Door Module for a Refrigerated Case" and filed on Jun. 9, 2010, the disclosure of which is incorporated herein by reference in its entirety.

BACKGROUND

The present invention relates generally to the field of temperature controlled display devices (e.g. refrigerated cases, etc.) for storing and displaying refrigerated or frozen objects. More specifically, the present invention relates to a door for refrigerated cases. More specifically still, the present invention relates to a door module having a central transparent panel with a peripheral flange that supports first and second lateral panels disposed on opposite sides of the central panel. The central panel serves as the structural backbone of the door module, and the remaining components of the door module are supported by the central panel via its peripheral flange.

It is well known to provide a temperature controlled display device such as a refrigerator, freezer, refrigerated merchandiser, refrigerated display case, etc., that may be used in commercial, institutional, and residential applications for storing or displaying refrigerated or frozen objects. For example, it is known to provide self-service type refrigerated display cases or merchandisers having doors that are intended for operation by consumers to access refrigerated or frozen objects (e.g. food products and the like, etc.) within the temperature controlled interior space. However, such known doors for temperature controlled display devices have a number of disadvantages. For example, the transparent panels used to provide a see-through thermal barrier are typically assembled into 'glass-packs' having complicated edge treatments for holding, sealing, and structurally supporting the glass panels together as an assembled unit. Such typical glass packs tend to be relatively fragile, and difficult and costly to assemble, and often rely on an external frame to provide structural stability for the transparent panel portion of the door.

Accordingly, it would be desirable to provide a door module for a temperature controlled display device that overcomes these and/or other disadvantages.

SUMMARY

One embodiment of the invention relates to a door module for a temperature controlled display device and includes a substantially transparent central panel having a planar portion integrally formed with a flange portion. The flange portion extends about a perimeter of the planar portion. A first lateral panel is disposed on a first side of the central panel in coplanar relation to the planar portion and is supported by a first side of the flange portion. A second lateral panel is disposed on a second side of the central panel in coplanar relation to the planar portion and is supported by a second side of the flange portion. A frame is coupled to the flange portion.

Another embodiment of the invention relates to a temperature controlled display device having a body portion at least partially defining an interior space for storing refrigerated or frozen objects therein. The display device includes a door module coupled to the body portion and movable between and open position and a closed position to provide access to the interior space. The door module includes a central panel substantially surrounded by an integrally formed flange, and a first panel disposed on a first side of the central panel and supported by a first side of the flange, and a second panel disposed on a second side of the central panel and supported by a second side of the flange, and a frame coupled to the flange.

Yet another embodiment of the invention relates to a door module for a temperature controlled display device. The door module includes a central panel integrally formed with a peripheral flange. A first panel is disposed on a first side of the central panel and is supported by a first side of the flange. A second panel is disposed on a second side of the central panel and is supported by a second side of the flange. A first seal is disposed between the first side of the flange and the first panel, and a second seal is disposed between the second side of the flange and the second panel. A channel is provided within the flange and a desiccant material is disposed in the channel. A first opening extends from the channel to a first space between the first panel and the central panel, and a second opening extends from the channel to a second space between the second panel and the central panel. A frame is coupled to the flange portion and at least partially overlaps the first panel and the second panel.

DETAILED DESCRIPTION

Referring to the FIGURES, an exemplary embodiment of a door module for a temperature-controlled display device (e.g. refrigerated case, etc) is disclosed.

Figure 1:
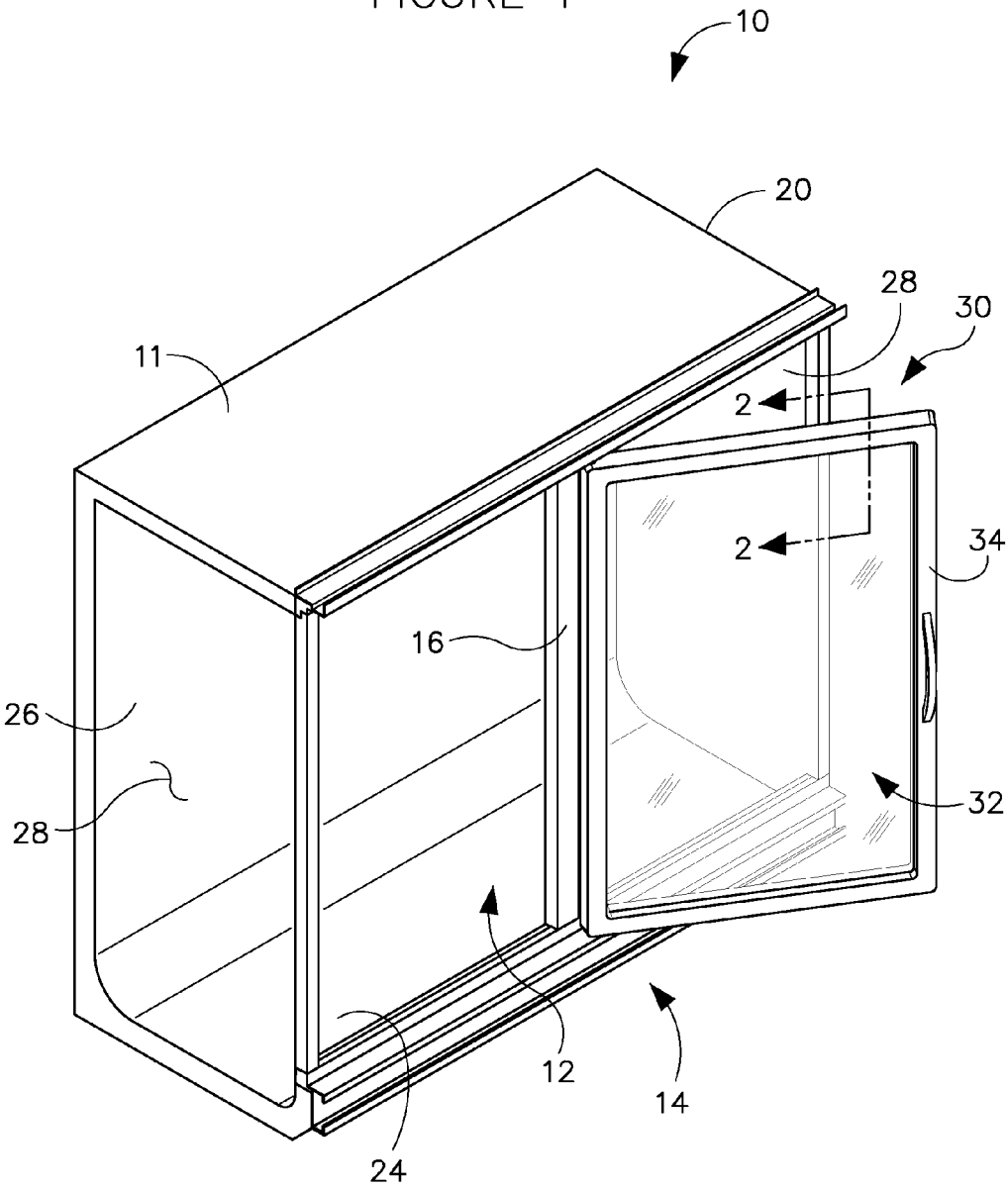
FIG. 1 is a schematic image of a perspective view of a temperature controlled display device having a door module according to an exemplary embodiment.

Referring more particularly to FIG. 1, a temperature controlled display device shown for example as a self-service type refrigerated case 10 having a door module 30 is shown according to an exemplary embodiment. Refrigerated case 10 is shown to include a body portion 20 (e.g. tank, tub, etc.) having a top wall 11, bottom wall 24, back wall 26, and side walls 28 that at least partially define an interior space 12 for storing frozen or refrigerated products therein, and a generally open front 14 having a frame 16. A door module 30 is coupled to the frame 16 (e.g. pivotally) for movement between and open position and a closed position to enclose the open front 14 and to permit access to the interior space 12 through the openings.

Figure 2:
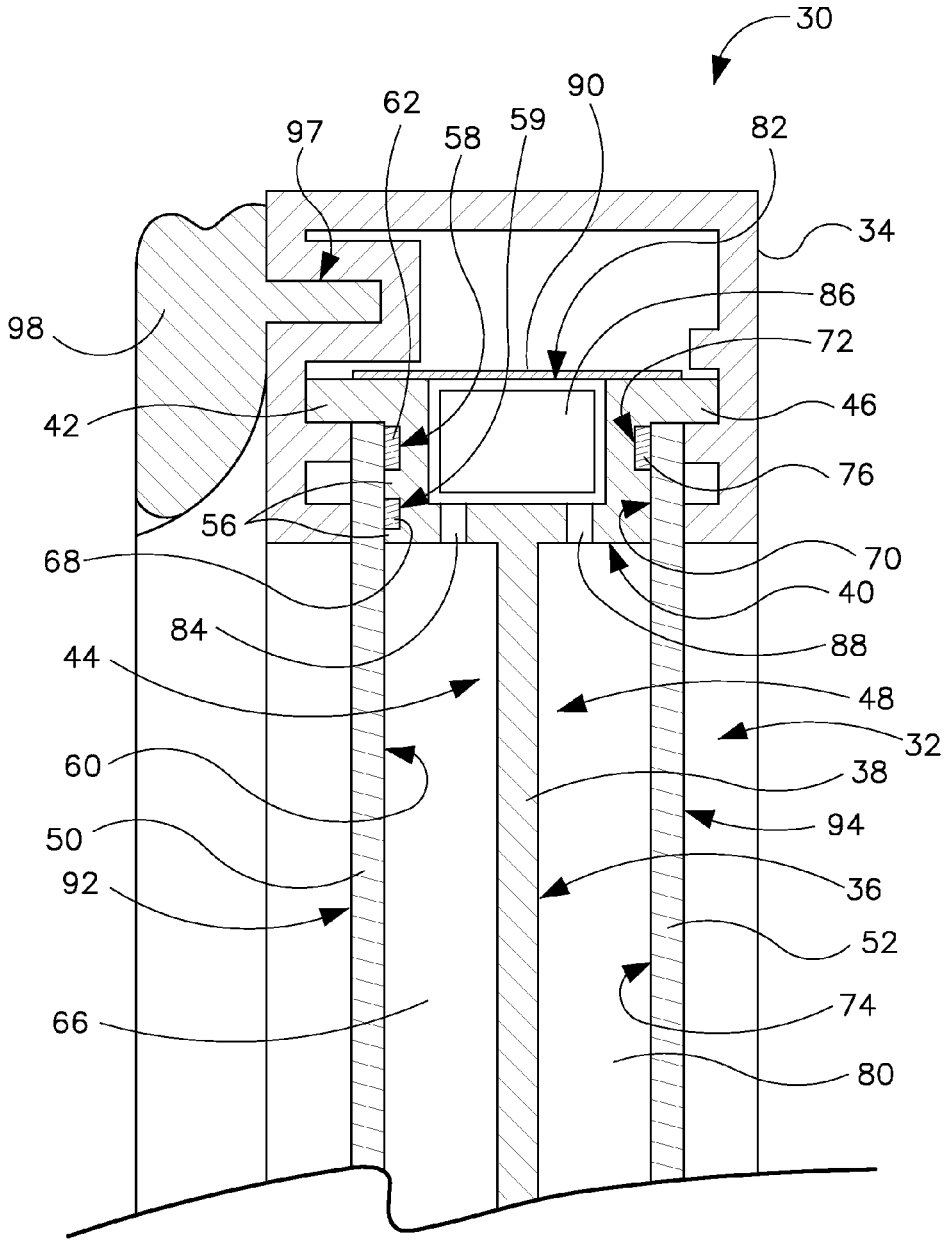
FIG. 2 is a schematic image of a cross-sectional view taken along lines 2-2 of FIG. 1 according to an exemplary embodiment.

Referring more particularly to FIG. 2, the door module 30 is formed as an assembly 32 of multiple transparent panels (e.g. panes, "lites," etc.) surrounded by a peripheral door frame 34 according to an exemplary embodiment. According to the illustrated embodiment, the assembly 32 includes a central panel 36 which serves as the structural foundation of the door module (e.g. building block, backbone, spine, etc.). Central panel 36 is shown to include a substantially transparent planar portion 38 surrounded about its perimeter by an integrally formed flange portion 40 (e.g. rim, border, web, etc.). Flange portion 40 is shown to extend substantially around the perimeter of the planar portion 38 and includes a first projection 42 extending from a first side 44 of the central panel 36 and a second projection 46 extending from a second side 48 of the central panel 36. The first projection 42 extends substantially about the perimeter of the planar portion 38 and is configured to receive and support a first substantially transparent lateral panel 50 disposed in a closely adjacent and parallel-planar manner on the first side 44 of the central panel 36. The second projection 46 extends substantially about the perimeter of the planar portion 38 and is configured to receive and support a second substantially transparent lateral panel 52 disposed in a closely adjacent and parallel-planar manner on the second side of the central panel 36. According to one embodiment, central panel 36 is formed from a polycarbonate material and the first and second lateral panels are formed from tempered glass. However, according to alternative embodiments, other materials may be used that have suitable optical, structural and insulative properties.

Referring further to FIG. 2, the first side 44 of flange portion 40 is further shown to include one or more lands 56 (e.g. ridges, ribs, etc.—shown for example as two lands 56) with corresponding grooves 58, 59 disposed therebetween. Lands 56 provide lateral support for an inside surface 60 of the first lateral panel 50. Groove 58 defines a space for a seal 62 that extends about the perimeter of the planar portion 38 to provide an airtight seal between the flange portion 40 and the first lateral panel 50 to define a first enclosed space 66 between the central panel 36 and the first lateral panel 50. According to one embodiment, seal 62 comprises a resilient O-ring, or a conformable sealant or another suitable seal material disposed within groove 58 and configured to seal against inside surface 60 of first lateral panel 50. Groove 59 defines a space for routing of an electrical conductor 68 (e.g. wires, busbar, etc.) for conducting electricity from a power supply to one or more electrical devices associated with door module 30, such as anti-condensation heaters, lighting devices, etc. According to an alternative embodiment, an electrical conductor, such as a busbar, may be integrally formed within the flange portion (e.g. during a molding operation, etc.)

Referring further to FIG. 2, the second side 48 of flange portion 40 is further shown to include one or more lands 70 (e.g. ridges, ribs, etc.—shown for example as one land 70) with a corresponding groove 72 disposed between land 70 and projection 46. Land 70 provides lateral support for an inside surface 74 of the second lateral panel 52. Groove 72 defines a space for a seal 76 that extends about the perimeter of the planar portion 38 to provide an airtight seal between the flange portion 40 and the second lateral panel 52 to define a second enclosed space 80 between the central panel 36 and the second lateral panel 52. According to one embodiment, seal 76 comprises a resilient O-ring, a conformable sealant or another suitable seal material disposed within groove 72 and configured to seal against inside surface 74 of second lateral panel 52.

Referring further to FIG. 2, flange portion 40 includes a channel 82 extending substantially around the perimeter of the central panel 36. A first plurality of apertures 84 (e.g. holes, slots, etc.) are formed in flange portion 40 and extend between channel 82 and first space 66 to define a first passageway therebetween so that the volume within first space 66 is exposed to the desiccant 86 in the channel 82. According to the illustrated embodiment, channel 82 is sufficiently wide so that it 'straddles' the planar portion 38 of central panel 36. A second plurality of apertures 88 (e.g. holes, slots, etc.) are formed in flange portion 40 and extend between channel 82 and second space 80 to define a second passageway therebetween so that the volume within second space 80 is exposed to the desiccant 86 in the channel 82. A moisture barrier 90 extends over the channel 82 and is sealed on opposite sides of the channel 82 to the flange portion 40 to enclose the desiccant 86 in the channel 82 provide and air and moisture tight barrier. According to one embodiment, moisture barrier 90 is formed from a material such as lacquer or polyurethane during a co-molding operation for making the central panel 36, or may be accomplished as a post-mold spray operation. According to other embodiments, the moisture barrier may be provided as another material (e.g. foil, polymer, etc.) that is adhered or otherwise bonded to the flange portion 40 to enclose and seal the channel 82.

Figure 3:
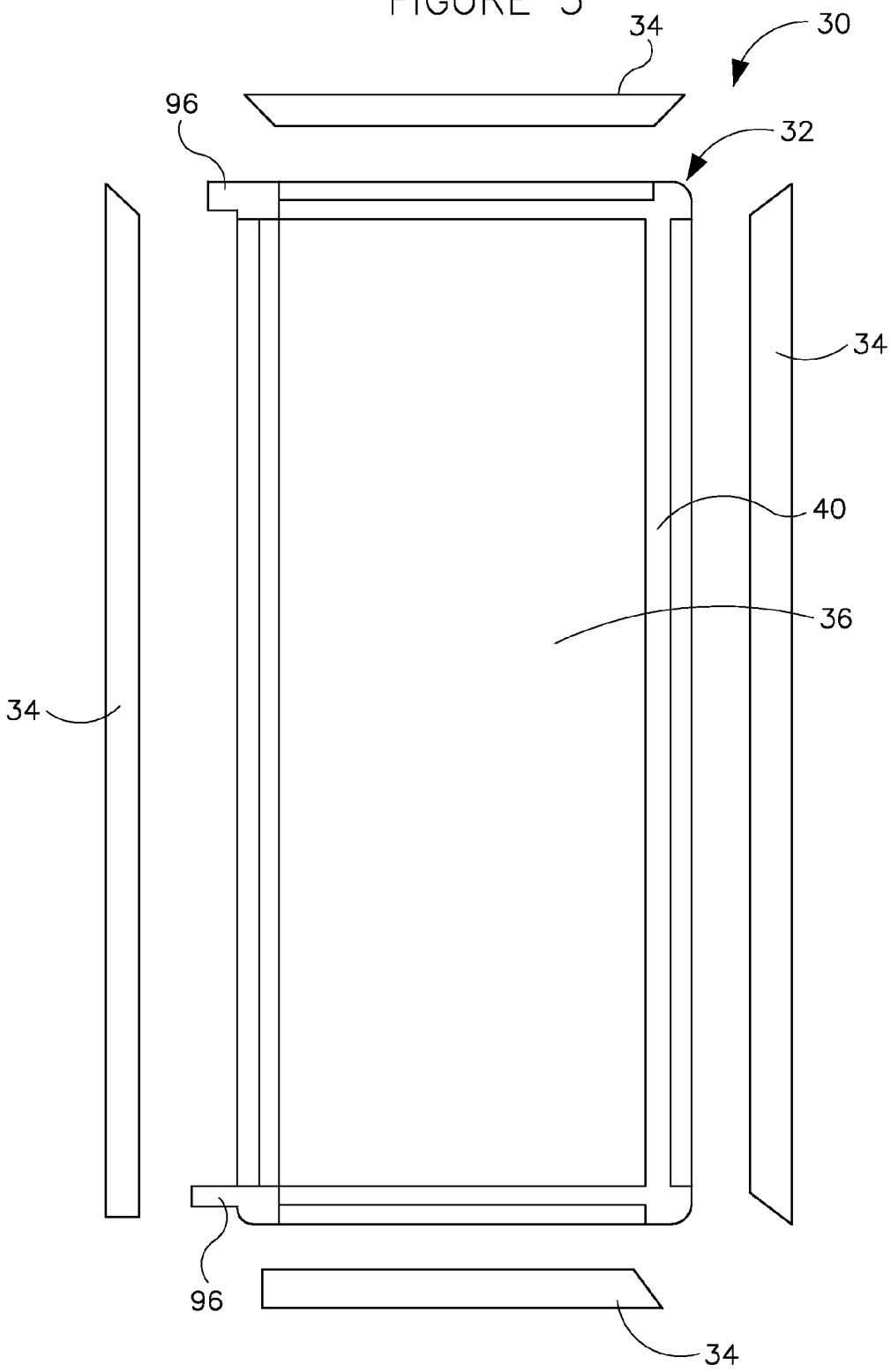
FIG. 3 is a schematic image of an exploded perspective view of the door of FIG. 2 according to an exemplary embodiment.

Referring further to FIGS. 2 and 3, a peripheral door frame 34 is coupled about the flange portion 40 and around the perimeter of the central panel 36 and overlaps an outside surface 92, 94 of the first and second lateral panels 50, 52 to secure (e.g. lock, etc.) the first and second lateral panels 50, 52 against the central panel 36 and to receive other components of the door module, such as mounting brackets 96 (e.g. supports, etc.), or lighting devices, anti-condensation heaters, etc. (not shown). The peripheral door frame 34 may also be provided with suitable receiving structure, shown for example as slot 97, to receive a thermal gasket 98 (e.g. in a snap-in or press-in manner or the like).

According to one embodiment (e.g. a low temperature application), the peripheral door frame 34 comprises a substantially solid frame made from a polyurethane material, which may be formed about the flange portion 40 in a reaction injection molding operation, in which case, the mounting brackets or supports 96 may be insert-molded directly into the peripheral door frame 34. According to another embodiment (e.g. medium temperature applications), the peripheral door frame 34 may be formed from extruded members (e.g. vinyl, plastic, polymer, aluminum, etc.) which may be hollow and secured at the corners (e.g. in a 'picture frame' like manner) about the flange portion 40. Such a solid or hollow peripheral door frame may be of a type shown and described in U.S. patent application Ser. No. 12/797,246, titled "Modular Door System for Refrigerated Case" and filed on Jun. 9, 2010, the disclosure of which is hereby incorporated by reference in its entirety.

According to any preferred embodiment, a temperature controlled display device shown as a refrigerated case has a body portion at least partially defining an interior space for storing refrigerated or frozen objects therein. A frame is coupled to the body portion and defines at least one opening with a door module coupled thereto for movement between a closed position and open position to permit access to the interior space. A central panel serves the dual purposes of providing a transparent central panel for see-through viewing of the door module, and also as the structural backbone of the door module by supporting the first and second lateral panels and the outer peripheral door frame. The flange portion of the central panel further includes sealing structures to support and seal the lateral panels in a parallel coplanar manner with the central panel. Additional features such as a desiccant channel and passageways may be provided in the flange portion to reduce the potential for condensation of fogging in the space between the lateral panels and the central panels. Other components of the door module may be formed or otherwise provided in the central panel, including electrical conductors and support brackets.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It should be noted that the orientation of various elements may differ according to other exemplary embodiments, and that such variations are intended to be encompassed by the present disclosure.

It is also important to note that the construction and arrangement of the door module for a temperature controlled storage device as shown in the various exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed herein. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the various exemplary embodiments without departing from the scope of the present inventions.

What is claimed is:

1. A door module for a temperature controlled display device, comprising:

a substantially transparent central panel having a planar portion integrally formed with a flange portion, the flange portion extending substantially about a perimeter of the planar portion and having a channel with a desiccant material disposed therein;

a first lateral panel disposed on a first side of the central panel in parallel relation to the planar portion and supported by a first side of the flange portion;

a second lateral panel disposed on a second side of the central panel in parallel relation to the planar portion and supported by a second side of the flange portion;

a first opening extending from the channel to a first space between the first lateral panel and the planar portion, and a second opening extending from the channel to a second space between the second lateral panel and the planar portion; and a frame coupled to the flange portion.

2. The door module of claim 1 wherein the planar portion and flange portion of the central panel are integrally formed from a polycarbonate material in a compression injection molding operation.

3. The door module of claim 1 wherein the flange portion is substantially symmetric relative to the planar portion.

4. The door module of claim 1 further comprising a first seal disposed at least partially within a recess in the first side of the flange and providing a seal between the first side of the flange portion and the first lateral panel.

5. The door module of claim 4 further comprising a second seal disposed at least partially within a recess in the second side of the flange and providing a seal between the second side of the flange portion and the second lateral panel.

6. The door module of claim 1 wherein the flange portion further comprises a passageway with an electrical conductor disposed therein.

7. The door module of claim 1 further comprising a moisture barrier coupled to the flange and enclosing the channel.

8. The door module of claim 1 wherein the frame comprises a polyurethane material formed at least partially about the flange portion in a reaction injection molding operation.

9. A temperature controlled display device having a body portion at least partially defining an interior space for storing refrigerated or frozen objects therein, the display device comprising:

a door module coupled to the body portion and movable between an open position and a closed position to provide access to the interior space, the door module comprising:

a central panel having an integrally formed peripheral flange having a channel with a desiccant material disposed therein;

a first panel disposed on a first side of the central panel and supported by a first side of the flange;

a second panel disposed on a second side of the central panel and supported by a second side of the flange;

a first opening extending from the channel to a first space between the first panel and the central panel, and a second opening extending from the channel to a second space between the second panel and the central panel; and a frame coupled to the flange.

10. The temperature controlled display device of claim 9 wherein the central panel and flange are integrally formed from a polycarbonate material in a compression injection molding operation.

11. The temperature controlled display device of claim 9 wherein the flange is substantially symmetric relative to the central panel.

12. The temperature controlled display device of claim 9 further comprising a first seal disposed between the first side of the flange and the first panel.

13. The temperature controlled display device of claim 12 further comprising a second seal disposed between the second side of the flange and the second panel.

14. The temperature controlled display device of claim 9 wherein the flange further comprises a passageway with an electrical conductor disposed therein.

15. The temperature controlled display device of claim 9 further comprising a moisture barrier coupled to the flange and enclosing the channel.

16. The temperature controlled display device of claim 9 wherein the frame comprises a polyurethane material formed at least partially about the flange and at least partially overlapping the first panel and the second panel.

* * * * *